US011421384B2

(12) United States Patent
Rekoske et al.

(10) Patent No.: US 11,421,384 B2
(45) Date of Patent: Aug. 23, 2022

(54) SOFT TEXTURED TISSUE

(71) Applicant: Kimberly-Clark Worldwide, Inc., Neenah, WI (US)

(72) Inventors: Michael John Rekoske, Appleton, WI (US); David Matthew VanBergen, Muskegon, MI (US); John Paul David, Appleton, WI (US); Jessica Jan O'Connor, Appleton, WI (US); Gary Lee Shanklin, Fremont, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 168 days.

(21) Appl. No.: 16/646,358

(22) PCT Filed: Nov. 30, 2017

(86) PCT No.: PCT/US2017/063842

§ 371 (c)(1),
(2) Date: Mar. 11, 2020

(87) PCT Pub. No.: WO2019/108188

PCT Pub. Date: Jun. 6, 2019

(65) Prior Publication Data

US 2020/0270813 A1 Aug. 27, 2020

(51) Int. Cl.

| | |
|---|---|
| ***D21H 27/00*** | (2006.01) |
| ***D21H 27/02*** | (2006.01) |
| ***D21H 27/30*** | (2006.01) |
| ***D21F 11/14*** | (2006.01) |
| ***D21F 11/00*** | (2006.01) |

(52) U.S. Cl.
CPC ..... *D21F 11/145* (2013.01); *D21F 11/006* (2013.01); *D21H 27/002* (2013.01); *D21H 27/02* (2013.01); *D21H 27/30* (2013.01)

(58) Field of Classification Search
CPC .... D21H 27/002; D21H 27/005; D21H 27/02; D21H 27/30; D21F 11/006; D21F 11/145; A47K 10/16
See application file for complete search history.

(56) References Cited

U.S. PATENT DOCUMENTS

| | | | | |
|---|---|---|---|---|
| 6,423,180 | B1 | 7/2002 | Behnke et al. | |
| 6,610,173 | B1 | 8/2003 | Lindsay et al. | |
| 6,709,548 | B2 | 3/2004 | Marinack et al. | |
| 7,303,650 | B2 | 12/2007 | Hermans et al. | |
| 7,611,607 | B2 | 11/2009 | Mullally et al. | |
| 7,935,221 | B2 | 5/2011 | Allen et al. | |
| 7,972,474 | B2 | 7/2011 | Underhill et al. | |
| 8,287,986 | B2 | 10/2012 | Huss et al. | |
| 8,834,978 | B1 | 9/2014 | Hermans et al. | |
| 8,940,376 | B2 | 1/2015 | Stage et al. | |
| 8,968,516 | B2 | 3/2015 | Super et al. | |
| 9,340,914 | B2 | 5/2016 | Manifold et al. | |
| 9,435,080 | B2 | 9/2016 | Ostendorf et al. | |
| 9,657,443 | B2 | 5/2017 | Rekoske et al. | |
| 2006/0093788 | A1 | 5/2006 | Behm et al. | |
| 2007/0131367 | A1 | 6/2007 | Mathews et al. | |
| 2007/0137814 | A1* | 6/2007 | Gao | D21F 11/006 162/117 |
| 2009/0117331 | A1 | 5/2009 | Fung et al. | |
| 2012/0107568 | A1* | 5/2012 | Manifold | D21F 11/145 428/169 |
| 2012/0244241 | A1 | 9/2012 | McNeil | |
| 2012/0244320 | A1 | 9/2012 | Sauter et al. | |
| 2016/0331191 | A1* | 11/2016 | Manifold | D21H 27/002 |
| 2017/0009401 | A1* | 1/2017 | O'Brien Stickney | D21H 13/30 |
| 2017/0022670 | A1* | 1/2017 | Bailey | D21H 27/004 |
| 2017/0282525 | A1* | 10/2017 | Cabell | D21H 13/16 |
| 2018/0334778 | A1* | 11/2018 | Shannon | D21F 11/14 |
| 2020/0094513 | A1* | 3/2020 | Vogt | B32B 5/02 |
| 2020/0187725 | A1* | 6/2020 | Vogt | A47K 10/16 |
| 2020/0347553 | A1* | 11/2020 | Sealey, II | D21H 27/007 |
| 2020/0347554 | A1* | 11/2020 | Sealey, II | D21H 27/007 |
| 2021/0321831 | A1* | 10/2021 | Vogt | B32B 5/06 |
| 2021/0340710 | A1* | 11/2021 | Shannon | D21F 11/14 |

(Continued)

FOREIGN PATENT DOCUMENTS

| | | | | |
|---|---|---|---|---|
| CN | 105839448 | A | 8/2016 | |
| WO | 16085704 | A1 | 6/2016 | |
| WO | 16159966 | A1 | 10/2016 | |
| WO | 17066403 | A1 | 4/2017 | |
| WO | WO-2019108188 | A1 * | 6/2019 | D21F 11/145 |
| WO | WO-2021194505 | A1 * | 9/2021 | |

* cited by examiner

OTHER PUBLICATIONS

Cottonelle, "Dare To Go Commando With Cottonelle SummerSolstice", http://www.susiesreviews.com/2015/05/dare-to-go-commando-with-cottonelle.html.

*Primary Examiner* — Jose A Fortuna

(74) *Attorney, Agent, or Firm* — Kimberly-Clark Worldwide, Inc.

(57) ABSTRACT

Provided are tissue webs and products that have a modest degree of surface texture, but are still soft. In certain instances the tissue products and webs may also have good sheet bulk and low stiffness. For example, the tissue products may have good softness, such as a TS7 value (measured using the EMTEC Tissue Softness Analyzer) less than 11.0, and a textured surface, such as an R2 value from about 11,000 to about 20,000 (measured using an OpTiSurf tester). The foregoing tissue products may have a sheet bulk greater than about 8.0 cc/g and a Stiffness Index less than about 15.0. In certain instances the tissue product and webs may be through-air dried and may be either creped or uncreped.

14 Claims, 5 Drawing Sheets

(56) References Cited

U.S. PATENT DOCUMENTS

2021/0340711 A1* 11/2021 Sealey, II ..... D04H 1/4291
2022/0010497 A1* 1/2022 Bailey ..... A47K 10/16

SOFT TEXTURED TISSUE

BACKGROUND OF THE DISCLOSURE

Tissue products, such as facial tissues, paper towels, bath tissues, napkins, and other similar products, are designed to include several important properties. For example, the products should have good sheet bulk, a soft feel, and should have sufficient strength and durability to withstand use. Further, to improve wiping utility, it may be desirable to provide the product with a degree of surface texture. Unfortunately, however, when steps are taken to increase one property of the product, other characteristics of the product are often adversely affected.

One means to balance important tissue product properties is to manufacture the products by processes that do not compress the nascent web during drying. Such processes often consist of non-compressive drying techniques in which the nascent web is molded to the contours of a patterned fabric that supports the web as it is dried. The wet molded web is typically dried by passing heated air through both the fabric and the wet web as it is transported over a cylindrical dryer. In this manner the web is imparted with a three-dimensional pattern and its bulk is maintained.

One widely used non-compressive drying process used to manufacture tissue products is through-air drying, which consists of transferring a wet-laid web to a coarse, highly permeable through-air drying fabric imparted with three-dimensional surface topography. The wet-laid web is molded to the through-air drying fabric and is supported by the fabric until it is at least almost completely dry. The resulting dried web is softer and bulkier than compressively dewatered tissue webs, such as wet-pressed webs, because fewer papermaking bonds are formed and because the web is less dense. Further, the through-air dried web often has a three-dimensional pattern imparted by the through-air drying fabric.

While through-air drying results in softer and bulkier webs compared to manufacturing processes that rely upon compression to dewater the web, the process has limitations. To generate bulk, tissue makers often employ coarse through-air drying fabrics having a high degree of surface topography. As the wet web is molded to the high topography fabrics and dried it retains the shape of the fabric resulting in a dried tissue web having a high degree of surface topography. While such topography contributes to bulk it may impart the web with a rough surface and decrease the perceived softness of the web. Unfortunately, simply reducing the coarseness and topography of the through-air drying fabric to produce a smoother, less bulky web is not sufficient to improve softness because, when the surface topography is reduced the web becomes denser and fiber-fiber bonding is increased, which has a negative effect on softness. Thus, providing a through-air dried tissue web having good bulk and surface texture, while maintaining softness has proven to be elusive.

Unexpectedly, the present inventors have found a way to decouple the prior art relationship between surface texture, density and softness. Accordingly, it is now possible to improve the surface topography of tissue without encountering the concomitant loss of softness that occurs in the prior art. Further, in certain instance, the bulk of the tissue web may be maintained. Therefore, softness levels, previously unattainable at relatively high degrees of surface texture and sheet bulk, are possible with the present invention.

SUMMARY OF THE DISCLOSURE

The present inventors have successfully manufactured tissue products, for example facial and bath tissue products, having a moderate degree of surface texture, good bulk and good softness. Surprisingly the surface texture and bulk do not detract from the softness, such that tissue products generally have a TS7 less than 11.0 and still more preferably less than about 10.0, such as from about 7.0 to about 11.0 and more preferably from about 7.0 to about 10.0. Previously it was believed that such softness levels were only obtainable by smooth, relatively dense tissue products. The present inventors have discovered that the foregoing levels of softness are obtainable at an R2 value greater than about 11,000 and sheet bulks from about 8.0 to about 12.0 cc/g.

Accordingly, in one embodiment the present invention provides a multi-ply tissue product, such as a tissue product comprising two or more through-air dried tissue webs, the product having a TS7 less than 11.0 and an R2 value from about 11,000 to about 20,000.

In still other embodiments the present invention provides a multi-ply through-air dried tissue product having a TS7 from about 7.0 to about 11.00, an R2 value from about 11,000 to about 20,000 and a sheet bulk greater than about 8.0 cc/g.

In yet another embodiment the present invention provides a multi-ply through-air dried tissue product having a TS7 from about 7.0 to about 11.00 and a TS750 from about 30.0 to about 50.0. In certain instances the foregoing tissue product may have a sheet bulk greater than about 8.0 cc/g, such as from about 8.0 to about 12.0 cc/g, and a geometric mean tensile strength (GMT) greater than about 700 g/3", such as from about 700 to about 1,200 g/3".

In another embodiment the present invention provides a multi-ply through-air dried tissue product having a TS7 from about 7.0 to about 11.00, an R1 value from about 11,000 to about 15,000 and a sheet bulk greater than about 8.0 cc/g.

In other embodiments the present invention provides a multi-ply through-air dried tissue product having a TS7 from about 7.0 to about 11.00, an R1 value from about 11,000 to about 15,000, an R2 value from about from about 11,000 to about 20,000 and a sheet bulk greater than about 8.0 cc/g.

In yet other embodiments the present invention provides a multi-ply through-air dried tissue product comprising at least one tissue web having a three-dimensional surface topography imparted by a through-air drying fabric, the three-dimensional surface topography comprising a plurality of discrete protuberances having an angle of orientation, relative to the machine direction axis of the product, from about 10 to about 30 degrees, the product having a TS7 from about 7.0 to about 11.00 and an R2 value from about 11,000 to about 20,000.

In still other embodiments, the present invention provides a method of making a tissue web comprising the steps of: (a) forming an aqueous suspension of fibers (b) depositing an aqueous suspension of fibers onto a forming fabric traveling at a first rate of speed to form a wet web; (c) dewatering the web to a consistency of about 20 percent or greater; (d) transferring the web to a through-air drying fabric having a plurality of discrete protuberances having a height from about 0.50 to about 1.0 mm and an element angle from about 10 to about 45 degrees; and (e) through-air drying the web to form a dried tissue web having a TS7 from about 7.0 to about 11.00 and an R2 value from about 11,000 to about 20,000.

DEFINITIONS

Figure 1:
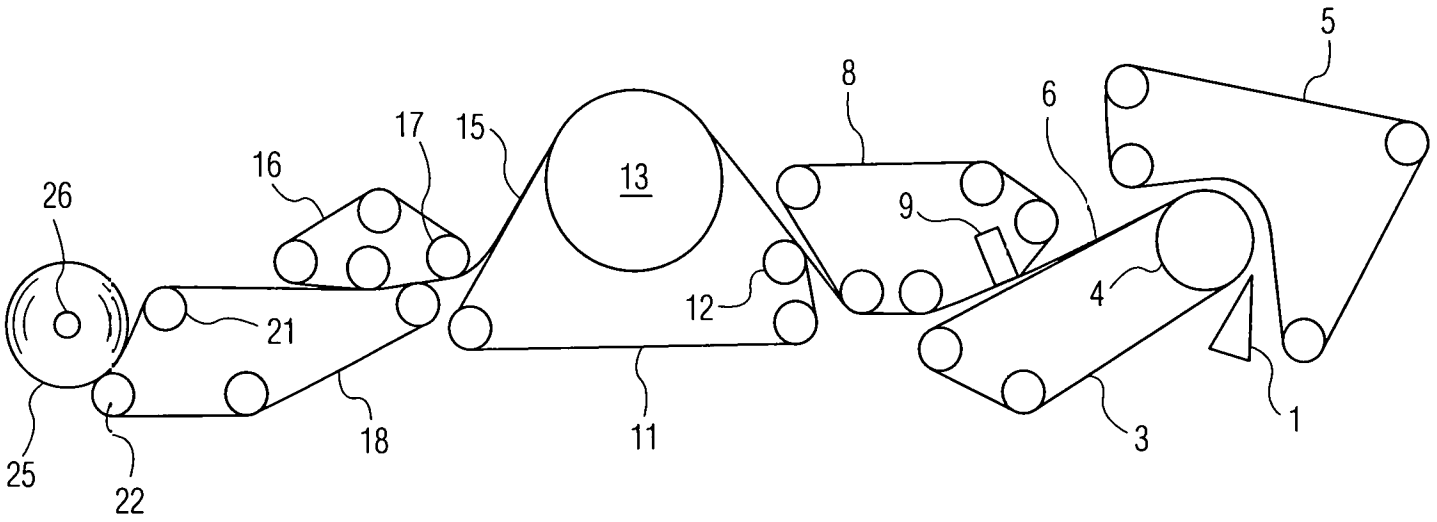
FIG. 1 is a schematic of a manufacturing process useful for manufacturing tissue webs according to the present invention.

As used herein, a "tissue product" generally refers to various paper products, such as facial tissue, bath tissue, paper towels, napkins, and the like. Normally, the basis weight of a tissue product of the present invention is less than about 80 grams per square meter (gsm), in some embodiments less than about 60 gsm, and in some embodiments from about 10 to about 60 gsm and more preferably from about 20 to about 50 gsm.

As used herein, the term "layer" refers to a plurality of strata of fibers, chemical treatments, or the like, within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

The term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "basis weight" generally refers to the bone dry weight per unit area of a tissue and is generally expressed as grams per square meter (gsm). Basis weight is measured using TAPPI test method T-220.

As used herein, the term "caliper" is the representative thickness of a single sheet (caliper of tissue products comprising two or more plies is the thickness of a single sheet of tissue product comprising all plies) measured in accordance with TAPPI test method T402 using a ProGage 500 Thickness Tester (Thwing-Albert Instrument Company, West Berlin, N.J.). The micrometer has an anvil diameter of 2.22 inches (56.4 mm) and an anvil pressure of 132 grams per square inch (per 6.45 square centimeters) (2.0 kPa). The caliper of a tissue product may vary depending on a variety of manufacturing processes and the number of plies in the product, however, tissue products prepared according to the present invention generally have a caliper greater than about 100 μm, more preferably greater than about 200 μm and still more preferably greater than about 300 μm, such as from about 100 to about 500 μm.

As used herein, the term "sheet bulk" refers to the quotient of the caliper (μm) divided by the bone dry basis weight (gsm). The resulting sheet bulk is expressed in cubic centimeters per gram (cc/g). Tissue products prepared according to the present invention generally have a sheet bulk greater than about 8.0 cc/g, more preferably greater than about 9.0 cc/g and still more preferably greater than about 10.0 cc/g.

As used herein, the term "slope" refers to slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of kilograms (kg).

As used herein, the term "geometric mean slope" (GM Slope) generally refers to the square root of the product of machine direction slope and cross-machine direction slope. GM Slope generally is expressed in units of kg.

As used herein, the terms "geometric mean tensile" and "GMT" refer to the square root of the product of the machine direction tensile strength and the cross-machine direction tensile strength of the web.

As used herein, the term "Stiffness Index" refers to the quotient of the geometric mean tensile slope, defined as the square root of the product of the MD and CD slopes (having units of kg), divided by the geometric mean tensile strength (having units of grams per three inches).

$$\text{Stiffness Index} = \frac{\sqrt{MD\ \text{Tensile Slope (kg)} \times CD\ \text{Tensile Slope (kg)}}}{GMT\ (g/3'')} \times 1{,}000$$

While the Stiffness Index may vary, tissue products prepared according to the present disclosure generally have a Stiffness Index less than about 5.0.

As used herein, the terms "TS7" and "TS7 value" refer to an output of an EMTEC Tissue Softness Analyzer ("TSA") (Emtec Electronic GmbH, Leipzig, Germany) as described in the Test Methods section. The units of the TS7 are dB $V^2$ rms, however, TS7 values are often referred to herein without reference to units.

As used herein, the terms "TS750" and "TS750 value" refer to the output of the EMTEC Tissue Softness Analyzer as described in the Test Methods section. TS750 has units of dB $V^2$ rms, however, TS750 may be referred to herein without reference to units.

DETAILED DESCRIPTION OF THE DISCLOSURE

Balancing of important tissue product properties such as softness, surface texture and bulk, while maintaining sufficient product strength and durability to withstand use, has traditionally been challenging for the tissue maker because many of the properties tend to be inversely related improve one, at the detriment of another. For example, consumers often desire a tissue product that is soft, but also has surface topography to enhance wiping utility and provide the product with a visually appealing aesthetic. Providing sufficient texture, however, often results in a tissue with a high degree of surface topography and poor softness. Bulk is also an important property for the absorption capacity and hand-feel of tissue webs and products. Increasing the bulk of tissue webs and products, however, often comes at the expense of other properties such as surface texture. Traditionally the tissue maker has needed to resort to high topography papermaking fabrics to achieve high bulk. While increasing the caliper of the tissue web at a given basis weight, and therefore the sheet bulk, the use of high topography fabrics often impart the web with a three-dimensional surface that is not particularly smooth.

The present inventors have now surprisingly discovered that certain papermaking fabrics and in particular through-air drying fabrics may be used to produce tissue webs having good surface texture without negatively affecting softness. In accordance with certain embodiments, the inventive tissue products may be manufactured using an endless papermaking belt, such as a through-air drying (TAD) fabric, having a plurality of protuberances separated from one another by landing areas. Together the landing areas and protuberances form a three-dimensional pattern on the web contacting surface of the fabric for cooperating with, and structuring of, the wet fibrous web during manufacturing.

The protuberances extend outwardly from the web contacting side of the fabric in the Z-direction (generally orthogonal to both the machine direction and cross-machine direction) above the bottom surface plane of the fabric. The protuberance may have a three-dimensional shape, having a length (L), a width (w), and a height (h). In certain embodiments the protuberances may have a height from about 0.50 to 3.0 mm, preferably from about 0.50 to about 1.50 mm, and in a particularly preferred embodiment from about 0.50 to about 1.00 mm, such as from about 0.50 to about 0.75 mm. The height (h) is generally measured as the distance between the bottom plane of web contacting surface of the fabric and the upper most surface plane of the protuberances.

The protuberances may be continuous, semi-continuous or discrete. In a particularly preferred embodiment the protuberances are discrete. Generally the protuberances are discrete and spaced apart from one another. Each protuberance is joined to a fabric structure and extends outwardly from the web contacting plane of the fabric structure. In this manner the protuberances contact the tissue web during manufacture. Further, the individual protuberances may be arranged in any number of different manners to create a decorative pattern. In one particular embodiment protuberances are spaced and arranged in a non-random, repeating pattern such as converging or diverging linear elements.

In particularly preferred embodiments the protuberances have a principle axis that crosses the machine direction axis to define an element angle (a). Preferably the element angle (a) is less than about 45 degrees and more preferably less than about 35 degrees, such as from about 10 to about 45 degrees and more preferably from about 15 to about 40 degrees and still more preferably from about 20 to about 35 degrees.

Figure 2:
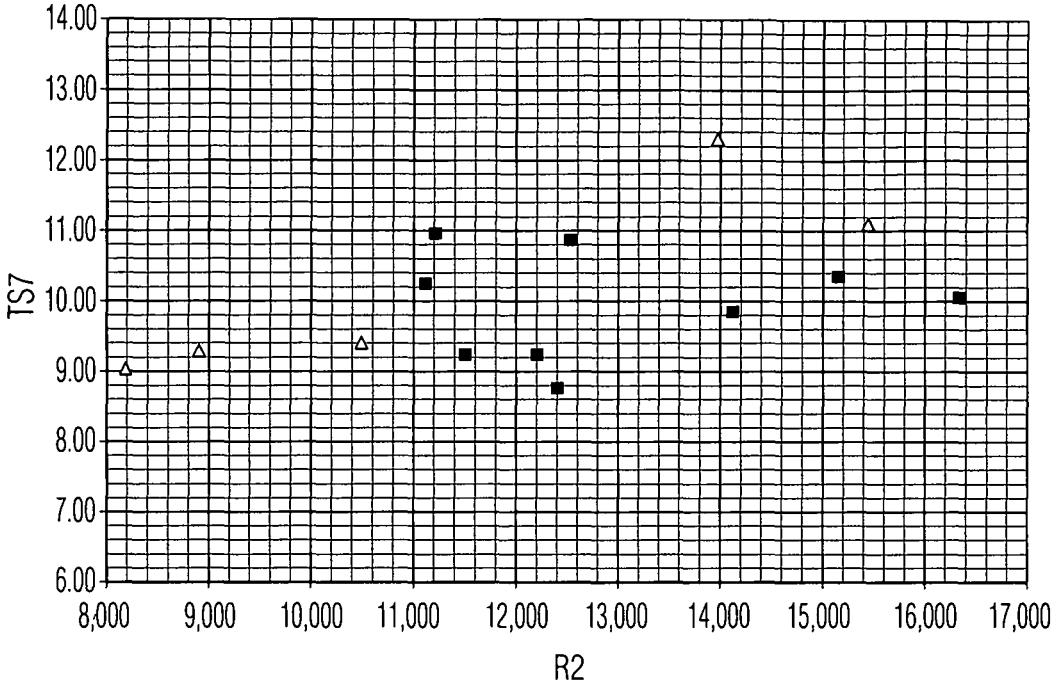
FIG. 2 is a graph of R2 (x-axis) and TS7 (y-axis) for inventive (■) and prior art (Δ) tissue products.
Figure 3:
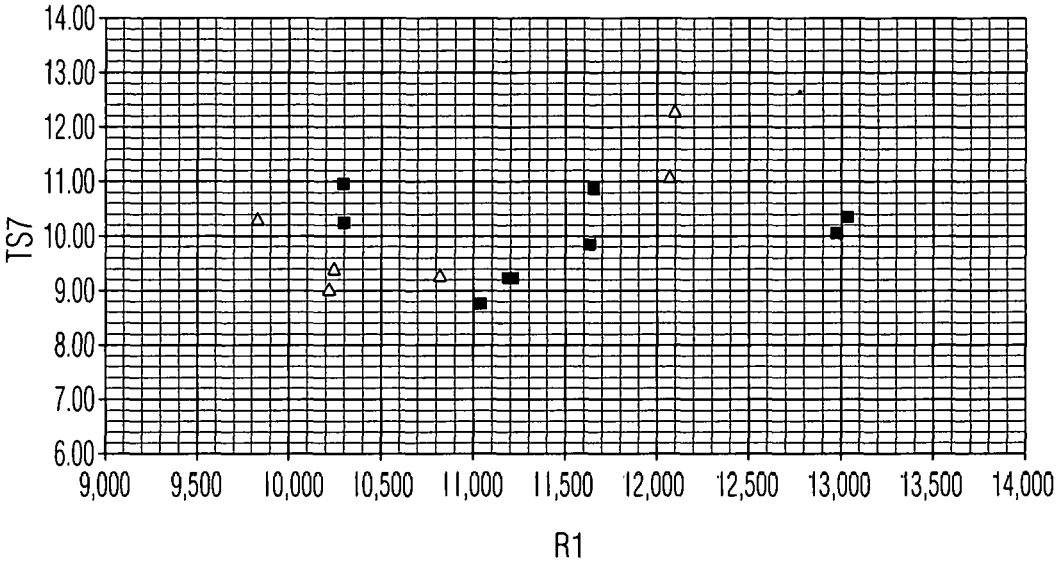
FIG. 3 is a graph of R1 (x-axis) and TS7 (y-axis) for inventive (■) and prior art (Δ) tissue products.

The arrangement of protuberances and landing areas yield a papermaking fabric having a three-dimensional surface topography, which when used to form a tissue web, produces a web having relatively uniform density, yet three-dimensional surface topography. The resulting web further has good bulk and improved softness at a relatively modest surface texture compared to webs and products made according to the prior art. For example, the present disclosure provides tissue products having relatively low TS7 values, such as less than 11.0, and modest degrees of surface texture, such as an R2 value (measured using an OpTiSurf tester and described in the Test Method section below) greater than about 11,000. In other instances the inventive products have relatively high TS750 values and low TS7 values, such as a TS750 greater than about 30.0 and a TS7 less than 11.0. These improvements translate into improved tissue products, as summarized in Table 1, below and illustrated in FIGS. 2 and 3.

TABLE 1

| Product | Manufacturing Process | Plies | TS7 | R1 | R2 |
|---|---|---|---|---|---|
| MCU7 | UCTAD | 2 | 10.96 | 10,295 | 11,210 |
| MCU8 | UCTAD | 2 | 10.25 | 10,297 | 11,115 |
| MCU9 | UCTAD | 2 | 8.76 | 11,038 | 12,400 |
| STLH | UCTAD | 2 | 9.24 | 11,189 | 12,202 |
| MHHL | UCTAD | 2 | 10.06 | 12,973 | 16,329 |
| MHLK | UCTAD | 2 | 9.85 | 11,631 | 14,123 |
| STMK | UCTAD | 2 | 10.87 | 11,654 | 12,529 |
| VMHD | UCTAD | 2 | 10.35 | 13,033 | 15,149 |
| S2HF | UCTAD | 2 | 9.24 | 11,213 | 11,502 |
| Kleenex Facial Tissue | CWP | 2 | 10.32 | 9,831 | 6,005 |
| Cottonelle Clean Care Double Roll | UCTAD | 1 | 11.10 | 12,071 | 15,447 |
| Cottonelle Gentle Care Double Roll | UCTAD | 1 | 12.30 | 12,095 | 13,978 |
| Scott Extra Soft Double Roll | UCTAD | 1 | 14.09 | 12,762 | 14,686 |
| Scott Towel | UCTAD | 1 | 24.36 | 13,128 | 15,224 |
| Puffs Basic Facial Tissue | CTAD | 2 | 9.29 | 10,821 | 8,904 |
| Puffs Ultra Soft & Strong Facial Tissue | CTAD | 2 | 9.03 | 10,219 | 8,188 |
| White Cloud Ultra Soft & Thick | CTAD | 2 | 16.44 | 15,170 | 10,743 |
| Charmin Ultra Soft Double Roll | CTAD | 2 | 9.41 | 10,248 | 10,490 |

Accordingly, in certain embodiments, the present invention provides tissue products or at least one tissue web employed in a tissue product manufactured using a patterned molding member, such as a papermaking fabric and more preferably a patterned through-air drying fabric, that imparts a three-dimensional patterns to the product or web. The pattern results in a product or web that has a moderate degree of topography, evidenced by an R2 value greater than about 11,000, yet are soft as evidenced by a TS7 value less than 11.0.

In another embodiment the present invention provides a multi-ply, such as a two-ply, tissue product, for example a folded facial tissue product, comprising a plurality of wood pulp fibers, wherein the multi-ply tissue product has a TS7 value less than 11.0, such as from about 7.0 to about 11.0, and an R2 value greater than about 11,000, such as from about 11,000 to about 20,000.

In yet another embodiment the present invention provides a multi-ply, such as a two-ply, tissue product, comprising a at least one uncreped, through-air dried patterned web comprising a plurality of wood pulp fibers, wherein the tissue product exhibits TS7 value less than 11.0, such as from about 7.0 to about 11.0, and an R2 value greater than about 11,000, such as from about 11,000 to about 20,000.

In other instances the surface texture of the instant tissue products and webs may be expressed as an R1 value as measured using an OpTiSurf tester and described in the Test Method section below. Accordingly, in certain embodiments, the inventive products and webs may have a TS7 value less than 11.0, and more preferably less than about 10.0, such as from about 7.0 to about 11.0 and more preferably from about 7.0 to about 10.0, and an R1 value greater than about 11,000, such as from about 11,000 to about 15,000 and more preferably from about 12,000 to about 15,000 and still more preferably from about 13,000 to about 15,000. For example, in one embodiment, the present invention provides a multi-ply, such as a two-ply, tissue product, comprising at least one uncreped, through-air dried patterned web comprising a plurality of wood pulp fibers, wherein the tissue product exhibits a TS7 value less than 11.0, such as from about 7.0 to about 11.0, and an R1 value greater than about 11,000, such as from about 11,000 to about 15,000.

In yet other instances the surface texture of the instant tissue products and webs may be expressed as a combination of R1 and R2 values. Accordingly, in certain embodiments, the inventive products and webs may have a TS7 value less than 11.0 and more preferably less than about 10.0, such as from about 7.0 to about 11.0 and more preferably from about 7.0 to about 10.0, an R1 value greater than about 11,000, such as from about 11,000 to about 15,000 and more preferably from about 12,000 to about 15,000, and an R2 value from about 11,000 to about 20,000. For example, in one embodiment, the present invention provides a multi-ply, such as a two-ply, tissue product, comprising at least one uncreped, through-air dried patterned web comprising a plurality of wood pulp fibers, wherein the tissue product exhibits a TS7 value less than 11.0, such as from about 7.0 to about 11.0, an R1 value from about 11,000 to about 15,000, and an R2 value from about 11,000 to about 20,000.

In still other instances the surface texture of the instant tissue products and webs may be expressed as a TS750 value as measured using an EMTEC Tissue Softness Analyzer (Emtec Electronic GmbH, Leipzig, Germany) and described in the Test Method section below. Accordingly, in certain embodiments, the inventive products and webs may have a TS7 value less than 11.0, such as from about 7.0 to about 11.0 and more preferably from about 7.0 to about 10.0, and an TS750 value greater than about 30.0, such as from about 30.0 to about 50.0 and more preferably from about 32.0 to about 45.0 and still more preferably from about 34.0 to about 42.0. For example, in one embodiment, the present invention provides a multi-ply, such as a two-ply, tissue product, comprising at least one uncreped, through-air dried patterned web comprising a plurality of wood pulp fibers, wherein the tissue product exhibits a TS7 value less than 11.0, such as from about 7.0 to about 11.0, and a TS750 value greater than about 30.0, such as from about 30.0 to about 50.0.

While having improved properties, the tissue products and/or webs prepared according to the present disclosure continue to be strong enough to withstand use by a consumer. For example, tissue webs prepared according to the present disclosure may have a geometric mean tensile (GMT) greater than about 600 g/3", such as from about 600 to about 1,500 g/3" and more preferably from about 800 to about 1,100 g/3".

Generally the tissue products and/or webs of the present invention have a basis weight of greater than 10 gsm, such as from about 10 to about 80 gsm, more preferably from about 15 to about 60 gsm and still more preferably from about 20 to about 50 gsm, such as from about 30 to about 45 gsm.

At the foregoing basis weights the tissue products and/or webs may have a sheet bulk greater than about 8.0 cc/g, such as from about 8.0 to about 12.0 cc/g and more preferably from about 9.0 to about 12.0 cc/g. In a particularly preferred embodiment the present invention provides a through-air dried tissue product comprising a plurality of pulp fibers and having a basis weight from about 30 to about 45 gsm and a sheet bulk from about 8.0 to about 12.0 cc/g.

In still other embodiments, the present disclosure provides tissue products and/or webs having good softness, a high degree of texture and good bulk. For example, the tissue products and/or webs may have a TS7 value less than 11.0, such as from about 7.0 to about 11.0, an R2 value greater than about 11,000, such as from about 11,000 to about 15,000 and a sheet bulk greater than about 8.0 cc/g, such as from about 8.0 to about 12.0 cc/g.

In yet other embodiments the tissue products and/or webs prepared as described herein are not overly stiff. For example, the instant tissue products may have a Stiffness Index less than about 15.0, more preferably less than about 12.0 and still more preferably less than about 10.0. The foregoing Stiffness Index may be achieved at a geometric mean slope less than about 10.0 kg, such as from about 4.0 to about 10.0 kg and in a particularly preferred embodiment from about 4.0 to about 8.0 kg.

The tissue products of the present invention are preferably wet-laid and comprise a plurality of fibers, such as cellulosic pulp fibers. In one example, the tissue products comprise a plurality of wood pulp fibers. In another example, the fibrous structure may comprise a plurality of non-wood pulp fibers, for example plant fibers, synthetic staple fibers, and mixtures thereof. Suitable cellulosic fibers for use in connection with this invention include secondary (recycled) papermaking fibers and virgin papermaking fibers in all proportions. Such fibers include, without limitation, hardwood and softwood kraft pulp fibers.

Non-limiting examples of processes for making fibrous structures include known wet-laid papermaking processes, for example through-air-dried papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous slurry is then used to deposit a plurality of fibers onto a forming wire, fabric, or belt such that an embryonic fibrous structure is formed, after which drying and/or bonding the fibers together results in a tissue web. Further processing of the tissue web may be carried out such that a finished tissue product is formed.

Examples of papermaking processes and techniques useful in forming tissue webs and products according to the present invention include, for example, those disclosed in U.S. Pat. Nos. 5,048,589, 5,399,412, 5,129,988 and 5,494,554 all of which are incorporated herein in a manner consistent with the present disclosure. In one embodiment the tissue web is formed by through-air drying and may be either creped or uncreped. When forming multi-ply tissue products, the separate plies can be made from the same process or from different processes as desired.

The forming process of the present disclosure may be any conventional forming process known in the papermaking industry. Such formation processes include, but are not limited to, Fourdriniers, roof formers such as suction breast roll formers, and gap formers such as twin wire formers and crescent formers.

The drying process can be any noncompressive drying method which tends to preserve the bulk or thickness of the wet web including, without limitation, throughdrying, infrared radiation, microwave drying, etc. Because of its commercial availability and practicality, throughdrying is well known and is one commonly used means for noncompressively drying the web for purposes of this invention. The web is preferably dried to final dryness on the through-air drying fabric, without being pressed against the surface of a Yankee dryer, and without subsequent creping.

In other embodiments, once the wet tissue web has been non-compressively dried, thereby forming a dried tissue web, it is possible to crepe the dried tissue web by transferring the dried tissue web to a Yankee dryer prior to reeling, or using alternative foreshortening methods such as microcreping as disclosed in U.S. Pat. No. 4,919,877.

The tissue webs of the present invention may be converted into single or multi-ply tissue products, the inventive webs may be converted into rolled or sheets of folded tissue product. Rolled tissue products may comprise a plurality of connected, but perforated sheets that may be dispensed as adjacent sheets. In another example, the inventive tissue products may be in the form of discrete sheets that are stacked within and dispensed from a container, such as a box.

Tissue webs of the present invention may be homogeneous or may be layered. If layered, the tissue web may comprise two or more layers, such as two, three, or four layers. If desired, various chemical compositions may be applied to one or more layers of the multi-layered tissue web to further enhance softness and/or reduce the generation of lint or slough. For example, in some embodiments, a wet strength agent can be utilized, to further increase the strength of the tissue product. As used herein, a "wet strength agent" is any material that, when added to pulp fibers can provide a resulting web or sheet with a wet geometric tensile strength to dry geometric tensile strength ratio in excess of about 0.1. Typically these materials are termed either "permanent" wet strength agents or "temporary" wet strength agents. As is well known in the art, temporary and permanent wet strength agents may also sometimes function as dry strength agents to enhance the strength of the tissue product when dry.

Wet strength agents may be applied in various amounts, depending on the desired characteristics of the web. For instance, in some embodiments, the total amount of wet strength agents added can be between about 1 to about 30 pounds per ton (lbs/T), such as from about 5 to about 20 lbs/T, and more preferably from about 5 to about 10 lbs/T of the dry weight of fibrous material. The wet strength agents can be incorporated into any layer of a multi-layered tissue web.

A chemical debonder can also be applied to soften the web. Specifically, a chemical debonder can reduce the amount of hydrogen bonds within one or more layers of the web, which results in a softer product. Depending on the desired characteristics of the resulting tissue product, the debonder can be utilized in varying amounts. For example, in some embodiments, the debonder can be applied in an amount between about 1 to about 30 lbs/T, in some embodiments between about 3 to about 20 lbs/T, and in some embodiments between about 6 to about 15 lbs/T of the dry weight of fibrous material. The debonder can be incorporated into any layer of the multi-layered tissue web.

Any material capable of enhancing the soft feel of a web by disrupting hydrogen bonding can generally be used as a debonder in the present invention. In particular, as stated above, it is typically desired that the debonder possess a cationic charge for forming an electrostatic bond with anionic groups present on the pulp. Some examples of suitable cationic debonders can include, but are not limited to, quaternary ammonium compounds, imidazolinium compounds, bis-imidazolinium compounds, diquaternary ammonium compounds, polyquaternary ammonium compounds, ester-functional quaternary ammonium compounds (e.g., quaternized fatty acid trialkanolamine ester salts), phospholipid derivatives, polydimethylsiloxanes and related cationic and non-ionic silicone compounds, fatty and carboxylic acid derivatives, mono and polysaccharide derivatives, polyhydroxy hydrocarbons, etc. For instance, some suitable debonders are described in U.S. Pat. Nos. 5,716,498, 5,730,839, and 6,211,139, all of which are incorporated herein in a manner consistent with the present disclosure.

Still other suitable debonders are disclosed in U.S. Pat. Nos. 5,529,665 and 5,558,873, both of which are incorporated herein in a manner consistent with the present disclosure. In particular, U.S. Pat. No. 5,529,665 discloses the use of various cationic silicone compositions as softening agents.

As described above, the tissue product of the present disclosure can generally be formed by any of a variety of papermaking processes known in the art. Preferably the tissue web is formed by through-air drying and be either creped or uncreped. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web.

In one embodiment, tissue webs may be creped through-air dried webs formed using processes known in the art. To form such webs, an endless traveling forming fabric, suitably supported and driven by rolls, receives the layered papermaking stock issuing from the headbox. A vacuum box is disposed beneath the forming fabric and is adapted to remove water from the fiber furnish to assist in forming a web. From forming fabric, a formed web is transferred to a second fabric, which may be either a wire or a felt. The fabric is supported for movement around a continuous path by a plurality of guide rolls. A pick up roll designed to facilitate transfer of the web from fabric to fabric may be included to transfer the web.

Preferably the formed web is dried by transfer to the surface of a rotatable heated dryer drum, such as a Yankee dryer. The web may be transferred to the Yankee dryer directly from the through-air drying fabric, or preferably, transferred to an impression fabric which is then used to transfer the web to the Yankee dryer. In accordance with the present disclosure, the creping composition of the present disclosure may be applied topically to the tissue web while the web is traveling on the fabric or may be applied to the surface of the dryer drum for transfer onto one side of the tissue web. In this manner, the creping composition is used to adhere the tissue web to the dryer drum. In this embodiment, as the web is carried through a portion of the rotational path of the dryer surface, heat is imparted to the web causing most of the moisture contained within the web to be evaporated. The web is then removed from the dryer drum by a creping blade. The creping web as it is formed further reduces internal bonding within the web and increases softness. Applying the creping composition to the web during creping, on the other hand, may increase the strength of the web.

In another embodiment the formed web is transferred to the surface of the rotatable heated dryer drum, which may be a Yankee dryer. The press roll may, in one embodiment, comprise a suction pressure roll. In order to adhere the web to the surface of the dryer drum, a creping adhesive may be applied to the surface of the dryer drum by a spraying device. The spraying device may emit a creping composition made in accordance with the present disclosure or may emit a conventional creping adhesive. The web is adhered to the surface of the dryer drum and then creped from the drum using the creping blade. If desired, the dryer drum may be associated with a hood. The hood may be used to force air against or through the web.

In other embodiments, once creped from the dryer drum, the web may be adhered to a second dryer drum. The second dryer drum may comprise, for instance, a heated drum surrounded by a hood. The drum may be heated from about 25 to about 200° C., such as from about 100 to about 150° C.

In order to adhere the web to the second dryer drum, a second spray device may emit an adhesive onto the surface of the dryer drum. In accordance with the present disclosure, for instance, the second spray device may emit a creping composition as described above. The creping composition not only assists in adhering the tissue web to the dryer drum, but also is transferred to the surface of the web as the web is creped from the dryer drum by the creping blade. Once creped from the second dryer drum, the web may, optionally, be fed around a cooling reel drum and cooled prior to being wound on a reel.

In addition to applying the creping composition during formation of the fibrous web, the creping composition may also be used in post-forming processes. For example, in one aspect, the creping composition may be used during a print-creping process. Specifically, once topically applied to a fibrous web, the creping composition has been found well-suited to adhering the fibrous web to a creping surface, such as in a print-creping operation.

For example, once a fibrous web is formed and dried, in one aspect, the creping composition may be applied to at least one side of the web and the at least one side of the web may then be creped. In general, the creping composition may be applied to only one side of the web and only one side of the web may be creped, the creping composition may be applied to both sides of the web and only one side of the web is creped, or the creping composition may be applied to each side of the web and each side of the web may be creped.

Once creped the tissue web may be pulled through a drying station. The drying station can include any form of a heating unit, such as an oven energized by infra-red heat, microwave energy, hot air, or the like. A drying station may be necessary in some applications to dry the web and/or cure the creping composition. Depending upon the creping composition selected, however, in other applications a drying station may not be needed.

In other embodiments, the base web is formed by an uncreped through-air drying process such as that illustrated in FIG. 1, in which a twin wire former having a papermaking headbox 1 deposits a furnish of an aqueous suspension of papermaking fibers onto a plurality of forming fabrics, such as the outer forming fabric 5 and the inner forming fabric 3, thereby forming a wet tissue web 6. The forming process of the present disclosure may be any conventional forming process known in the papermaking industry. Such formation processes include, but are not limited to, Fourdriniers, roof formers such as suction breast roll formers, and gap formers such as twin wire formers and crescent formers.

The wet tissue web 6 forms on the inner forming fabric 3 as the inner forming fabric 3 revolves about a forming roll 4. The inner forming fabric 3 serves to support and carry the newly-formed wet tissue web 6 downstream in the process as the wet tissue web 6 is partially dewatered to a consistency of about 10 percent based on the dry weight of the fibers. Additional dewatering of the wet tissue web 6 may be carried out by known paper making techniques, such as vacuum suction boxes, while the inner forming fabric 3 supports the wet tissue web 6. The wet tissue web 6 may be additionally dewatered to a consistency of at least about 20 percent, more specifically between about 20 to about 40 percent, and more specifically about 20 to about 30 percent.

The forming fabric 3 can generally be made from any suitable porous material, such as metal wires or polymeric filaments. For instance, some suitable fabrics can include, but are not limited to, Albany 84M and 94M available from Albany International (Albany, N.Y.) Asten 856, 866, 867, 892, 934, 939, 959, or 937; Asten Synweve Design 274, all of which are available from Asten Forming Fabrics, Inc. (Appleton, Wis.); and Voith 2164 available from Voith Fabrics (Appleton, Wis.). Forming fabrics or felts comprising nonwoven base layers may also be useful, including those of Scapa Corporation made with extruded polyurethane foam such as the Spectra Series.

The wet web 6 is then transferred from the forming fabric 3 to a transfer fabric 8 while at a solids consistency of between about 10 to about 35 percent, and particularly, between about 20 to about 30 percent. As used herein, a "transfer fabric" is a fabric that is positioned between the forming section and the drying section of the web manufacturing process.

Transfer to the transfer fabric 8 may be carried out with the assistance of positive and/or negative pressure. For example, in one embodiment, a vacuum shoe 9 can apply negative pressure such that the forming fabric 3 and the transfer fabric 8 simultaneously converge and diverge at the leading edge of the vacuum slot. Typically, the vacuum shoe 9 supplies negative machine direction pressure at levels between about 10 to about 25 inches of mercury. As stated above, the vacuum transfer shoe 9 (negative pressure) can be supplemented or replaced by the use of positive pressure from the opposite side of the web to blow the web onto the next fabric. In some embodiments, other vacuum shoes can also be used to assist in drawing the fibrous web 6 onto the surface of the transfer fabric 8.

Typically, the transfer fabric 8 travels at a slower speed than the forming fabric 3 to enhance the MD and CD stretch of the web, which generally refers to the stretch of a web in its machine (MD) or cross-machine direction (CD) (expressed as percent elongation at sample failure). For example, the relative speed difference between the two fabrics can be from about 1 to about 30 percent, in some embodiments from about 5 to about 20 percent, and in some embodiments, from about 10 to about 15 percent. This is commonly referred to as "rush transfer". During "rush transfer", many of the bonds of the web are believed to be broken, thereby forcing the sheet to bend and fold into the depressions on the surface of the transfer fabric 8. Such molding to the contours of the surface of the transfer fabric 8 may increase the MD and CD stretch of the web. Rush transfer from one fabric to another can follow the principles taught in any one of the following patents, U.S. Pat. Nos. 5,667,636, 5,830,321, 4,440,597, 4,551,199, 4,849,054, all of which are hereby incorporated by reference herein in a manner consistent with the present disclosure.

The wet tissue web 6 is then transferred from the transfer fabric 8 to a through-air drying fabric 11. Typically, the transfer fabric 8 travels at approximately the same speed as the through-air drying fabric 11. However, it has now been discovered that a second rush transfer may be performed as the web is transferred from the transfer fabric 8 to a through-air drying fabric 11. This rush transfer is referred to herein as occurring at the second position and is achieved by operating the through-air drying fabric 11 at a slower speed than the transfer fabric 8. By performing rush transfer at two distinct locations, i.e., the first and the second positions, a tissue product having increased CD stretch may be produced.

In addition to rush transferring the wet tissue web 6 from the transfer fabric 8 to the through-air drying fabric 11, the wet tissue web 6 may be macroscopically rearranged to conform to the surface of the through-air drying fabric 11 to give the desired bulk and appearance to the resulting dried tissue web. This is done with the aid of a vacuum transfer roll 12 or a vacuum transfer shoe like vacuum shoe 9. If desired, the through-air drying fabric 11 can be run at a speed slower than the speed of the transfer fabric 8 to further enhance MD stretch of the resulting absorbent tissue product. The transfer may be carried out with vacuum assistance to ensure conformation of the wet tissue web 6 to the topography of the through-air drying fabric 11.

The web is transferred to the through-air drying fabric for final drying preferably with the assistance of vacuum to ensure macroscopic rearrangement of the web to give the desired bulk and appearance. The use of separate transfer and through-air drying fabrics can offer various advantages since it allows the two fabrics to be designed specifically to address key product requirements independently. For example, the transfer fabrics are generally optimized to allow efficient conversion of high rush transfer levels to high MD stretch while through-air drying fabrics are designed to deliver bulk and CD stretch. It is therefore useful to have moderately coarse and moderately three-dimensional transfer fabrics and through-air drying fabrics which are quite coarse and three-dimensional in the optimized configuration. The result is that a relatively smooth sheet leaves the transfer section and then is macroscopically rearranged (with vacuum assist) to give the high bulk, high CD stretch surface topology of the through-air drying fabric. Sheet topology is completely changed from transfer to through-air drying fabric and fibers are macroscopically rearranged, including significant fiber-fiber movement.

While supported by the through-air drying fabric 11, the wet tissue web 6 is dried to a final consistency of about 94 percent or greater by a through-air dryer 13. The web 15 then passes through the winding nip between the reel drum 22 and the reel 26 and is wound into a roll of tissue 25 for subsequent converting, such as slitting cutting, folding, and packaging.

Suitable through-air drying fabrics may include, for example, papermaking fabrics having a plurality of three-dimensional protuberances disposed on the web contacting surface of the fabric. The protuberances may be formed from woven filaments or may be formed by casting a layer of an impervious resin surface onto a woven mesh supporting fabric. In other instances the protuberances are formed by printing or extruding polymeric material onto the web contacting surface of the fabric. Particularly suitable polymeric materials include materials that can be strongly adhered to the carrier structure and are resistant to thermal degradation at typical tissue machine dryer operating conditions and are reasonably flexible, such as silicones, polyesters, polyurethanes, epoxies, polyphenylsulfides and polyetherketones.

Figure 6:
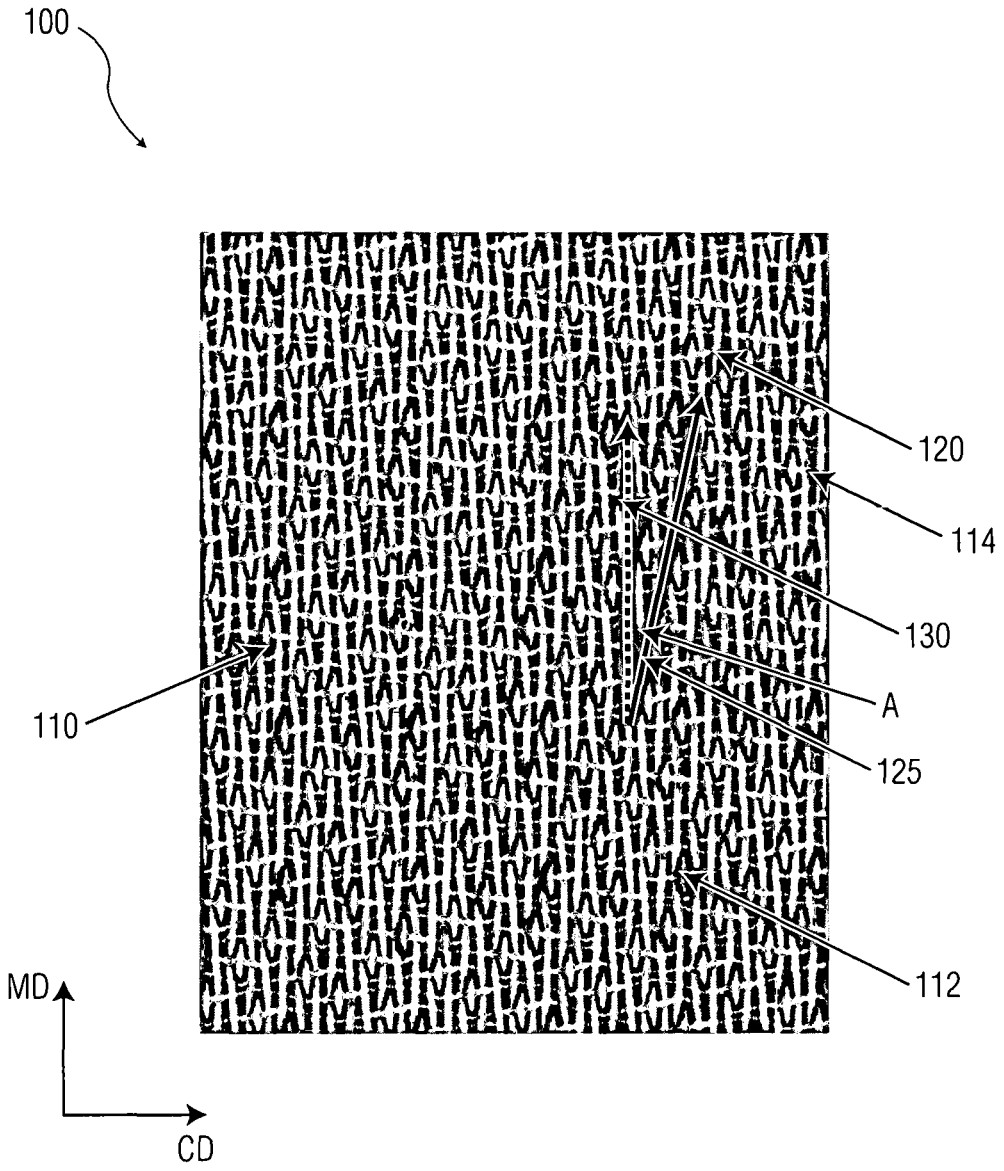
FIG. 6 is a top view of a woven papermaking fabric having a three-dimensional fabric contacting surface according to one embodiment of the present invention.

With reference to FIG. 6, a useful through-air drying fabric has two principle dimensions—a machine direction ("MD"), which is the direction within the plane of the fabric 100 parallel to the principal direction of travel of the tissue web during manufacture and a cross-machine direction ("CD"), which is generally orthogonal to the machine direction. The fabric 100 is generally permeable to liquids and air. In one particularly preferred embodiment the fabric is a woven fabric and more preferably a multi-layered plain-woven fabric having base warp yarns 112 interwoven with shute yarns 114.

In certain embodiments the web contacting surface 110 of the fabric 100 comprises a plurality of discrete protuberances 120 formed of warp yarns 112 woven in a non-random, repeating pattern. The protuberances 120 are generally disposed on the web contacting surface 110 for cooperating with, and structuring of, the wet fibrous web during manufacturing. In a particularly preferred embodiment the web contacting surface 110 comprises a plurality of spaced apart discrete three-dimensional protuberances 120 which together comprise at least about 15 percent of the web-contacting surface, such as from about 15 to about 35 percent, more preferably from about 18 to about 30 percent, and still more preferably from about 20 to about 25 percent of the web-contacting surface.

The protuberances 120 preferably have a height (h), measured from the bottom surface plane of the web contacting surface 112 of the fabric 110 and the upper most surface plane of the protuberance, from about 0.50 to 3.0 mm, preferably from about 0.50 to about 1.50 mm, and in a particularly preferred embodiment from about 0.50 to about 1.00 mm, such as from about 0.50 to about 0.75 mm.

As shown in the embodiment illustrated in FIG. 6, the protuberances 120 may be discrete and arranged with one another so as to have a first direction along a major axis 125 across one dimension of the web contacting surface 110 of the fabric 100. The discrete protuberances may be arranged with one another so as to form a continuous or discontinuous pattern across one dimension of the papermaking fabric. In those embodiments where the protuberances are arranged in a continuous fashion they may extend from a first lateral edge of the fabric to a second lateral edge. In such embodiments the length of the protuberance is dependent upon the length of the fabric and the angle of the protuberance relative to the machine direction (MD).

For example, discrete protuberances 120 may be offset from one another so as to define a generally continuous protuberance extending along a major axis 125 at an angle (A) relative to the machine direction axis 130. In this manner the protuberances 120 generally have a long direction axis, i.e., the major axis 125, which intersects the machine direction axis 130 to form an element angle (A), which is preferably from about 10 to about 45 degrees, such as from about 15 to about 25 degrees. While the illustrated protuberances are arranged in a parallel fashion and have the same element angle, the invention is not so limited. In other embodiments the element angle may vary amongst the protuberances.

Generally the protuberances are spaced apart from one another so as to define valleys there-between. In certain instances, such as when the instant papermaking fabrics are used as a through-air drying fabric, the fibers of the embryonic tissue web are deflected in the z-direction by the protuberances, which bound valleys, and are disposed along the valley plane to yield a web having a three-dimensional topography. For example, the foregoing papermaking fabrics may be used in the manufacture of a through-air dried tissue web having a three-dimensional surface topography disposed on the first or second surface of the tissue web, the topography comprising a plurality of discrete protuberances having an angle of orientation, relative to the machine direction axis of the product, from about 10 to about 30 degrees. In certain preferred embodiments the prouberances have a height greater than about 150 μm, such as from about 150 to about 200 μm. The web may be incorporated into a tissue product, such as two-ply tissue product, having a modest degree of surface texture, such as an R1 value greater than about 11,000, such as from about 11,000 to about 15,000, and an R2 value from about 11,000 to about 20,000. Despite having a three-dimensional surface topography and a modest degree of texture the tissue products are generally soft, such as a having a TS7 less than about 11.00, such as from about 7.0 to about 11.0 and more preferably from about 7.0 to about 10.0.

Test Methods

Profilometry

Figure 5:
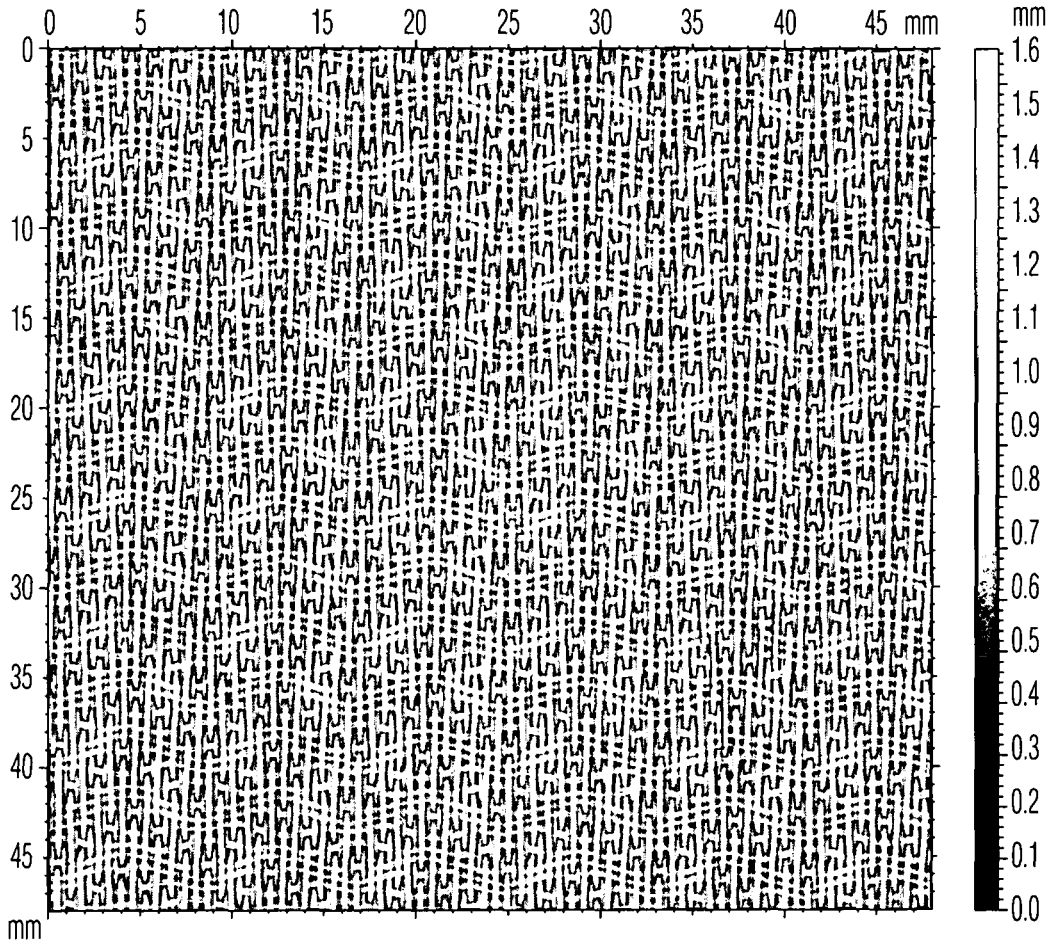
FIG. 5 is a profilometry scan of another through-air drying fabric having a three-dimensional fabric contacting surface useful in the present invention.

Profilometry scans of the fabric contacting surface of useful papermaking fabrics, such as those shown in FIGS. 5 and 6, were created using an FRT MicroSpy® Profile profilometer (FRT of America, LLC, San Jose, Calif.) and then analyzing the image using Nanovea® Ultra software version 7.4 (Nanovea Inc., Irvine, Calif.). Samples were cut into squares measuring 145×145 mm. The samples were then secured to the x-y stage of the profilometer using an aluminum plate having a machined center hole measuring 2×2 inches, with the fabric contacting surface of the sample facing upwards, being sure that the samples were laid flat on the stage and not distorted within the profilometer field of view.

Once the sample was secured to the stage the profilometer was used to generate a three-dimension height map of the sample surface. A 1602×1602 array of height values were obtained with a 30 μm spacing resulting in a 48 mm MD×48 mm CD field of view having a vertical resolution 100 nm and a lateral resolution 6 um. The resulting height map was exported to .sdf (surface data file) format.

Sheet Bulk

Sheet Bulk is calculated as the quotient of the dry sheet caliper (μm) divided by the bone dry basis weight (gsm). Dry sheet caliper is the measurement of the thickness of a single sheet of tissue product (comprising all plies) measured in accordance with TAPPI test method T402 using a ProGage 500 Thickness Tester (Thwing-Albert Instrument Company, West Berlin, N.J.). The micrometer has an anvil diameter of 2.22 inches (56.4 mm) and an anvil pressure of 132 grams per square inch (per 6.45 square centimeters) (2.0 kPa).

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3±0.05 inch (76.2±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm·cm/cm$^2$. Slope is recorded in units of kg. Both TEA and Slope are directional dependent and thus MD and CD directions are measured independently. Geometric mean TEA and geometric mean slope are defined as the square root of the product of the representative MD and CD values for the given property.

Surface Texture

Sample surface texture was analyzed using an OpTiSurf tester (OpTest Equipment Inc., Hawkesbury, Ontario, Canada). The OpTiSurf tester is a non-contact measurement tool that illuminates the surface of a sample and analyzes the shadows caused by surface topography. The texture intensities are obtained using Fast Fourier Transforms (FFT) and are presented in seven component ranges. In all instances a higher value indicates a more textured surface. Generally, measurements of surface texture reported here are the R1 (0.25-0.50 mm) and/or R2 (0.5-1.0 mm). All of the texture intensity values are calculated by the OpTiSurf tester.

The OpTiSurf tester was calibrated according to the manufacturers instructions. Individual samples were prepared by cutting a square sample (4 inches×4 inches) from the center of an experimental code or commercial tissue product using a commercially available precision cutter, such as a JDC-3 or equivalent precision cutter (commercially available from Thwing-Albert Instrument Company, Philadelphia, Pa.). Samples were mounted on a square sheet (4½ inches×4½ inches) of conventional white photocopy paper. Care was taken to mount the samples in the center of the photocopy paper so as to have a border of approximately ½ inch on all sides. Samples were mounted to the photocopy paper using tape and care was taken to secure the samples without wrinkles, folds or other defects. Further care was taken not to stretch the samples when mounting.

Mounted samples were analyzed using the OpTiSurf tester according to the manufacturer's instructions. Samples were analyzed from 20 mm to 80 mm from the leading edge of the sample and at 10 mm increments. The surface texture of each tissue sample was evaluated for both sides of the sample and in both the machine and cross-machine directions. For each side/orientation five replicate scans were performed and the results averaged to obtain R1 and R2 values for the given side/orientation. The R1 and R2 values for each side/orientation were averaged to obtain R1 and R2 values for a given sample.

Tissue Softness Analyzer (TSA)

Sample softness was analyzed using an EMTEC Tissue Softness Analyzer ("TSA") (Emtec Electronic GmbH, Leipzig, Germany). The TSA comprises a rotor with vertical blades which rotate on the test piece applying a defined contact pressure. Contact between the vertical blades and the test piece creates vibrations, which are sensed by a vibration sensor. The sensor then transmits a signal to a PC for processing and display. The signal is displayed as a frequency spectrum. The frequency analysis in the range of approximately 200 to 1000 Hz represents the surface properties of the test piece. A high amplitude peak correlates to a rougher surface. A further peak in the frequency range between 6 and 7 kHz represents the softness of the test piece. The peak in the frequency range between 6 and 7 kHz is herein referred to as the TS7 Softness Value and is expressed as dB $V^2$ rms. The lower the amplitude of the peak occurring between 6 and 7 kHz, the softer the test piece.

To measure TS750 a frequency analysis in the range of approximately 200 to 1000 Hz is performed with the amplitude of the peak occurring at 750 Hz being recorded as the TS750 value. The TS750 value represents the surface smoothness of the sample. A high amplitude peak correlates to a rougher surface. TS750 has units of dB $V^2$ rms. The TS750 value generally represents the structure of the sample which includes such things as any three-dimensional surface topography. Generally, samples having smooth surfaces with relatively low degrees of three-dimensional surface topography will produce a lower TS750 peak.

Test samples were prepared by cutting a circular sample having a diameter of 112.8 mm. All samples were allowed to equilibrate at TAPPI standard temperature and humidity conditions for at least 24-hours prior to completing the TSA testing. Only one ply of tissue is tested. Multi-ply samples are separated into individual plies for testing. The sample is placed in the TSA with the softer (dryer or Yankee) side of the sample facing upward. The sample is secured and the Softness Values measurements are started via the PC. The PC records, processes and stores all of the data according to standard TSA protocol. The reported TS7 and TS750 values is the average of five replicates, each one with a new sample.

Example

Basesheets were made using a through-air dried papermaking process commonly referred to as "uncreped through-air dried" ("UCTAD") and generally described in U.S. Pat. No. 5,607,551, the contents of which are incorporated herein in a manner consistent with the present disclosure. In all cases the basesheets were produced from a furnish comprising northern softwood kraft and eucalyptus kraft using a layered headbox fed by three stock chests such that the webs having three layers (two outer layers and a middle layer) were formed. The two outer layers comprised eucalyptus (each layer comprising 30 percent weight by total weight of the web) and the middle layer comprised softwood (the center layer comprising about 40 weight percent of the total basesheet). The amount of softwood and eucalyptus kraft in the middle layer was maintained for all inventive samples—the middle layered comprised 29 percent (by total weight of the web) softwood and 11 percent (by total weight of the web) eucalyptus. The bone dry basis weight and geometric mean tensile strengths (GMT) of the basesheets were varied through the use of refining and the addition of wet and/or dry strength additives as set forth in Table 2, below.

TABLE 2

| Sample | Furnish Layering | Wet Strength (kg/ton)/Layer | Dry Strength (kg/ton)/Layer | Debonder (kg/MT)/Layer | Refiner (HPD/MT)/Layer |
|---|---|---|---|---|---|
| MCU7 | EHWK/NSWK/EHWK | 5/Center | — | 2.5/First Outer Layer | — |
| MCU8 | EHWK/NSWK/EHWK | 5/Outer Layers | — | 2.5/First Outer Layer | — |
| MCU9 | EHWK/NSWK/EHWK | 5/Outer Layers | 2/Center | 2.5/First Outer Layer | 5/Center |
| STLH | EHWK/NSWK/EHWK | — | 2/Center | 2.5/First Outer Layer | 2/Center |
| MHHL | EHWK/NSWK/EHWK | 5/Outer Layers | 2/Center | 2.5/First Outer Layer | 0.2/Center |
| MHLK | EHWK/NSWK/EHWK | 0.2/Outer Layers | 2/Center | 2.5/First Outer Layer | 0.15/Center |
| STMK | EHWK/NSWK/EHWK | — | 5/Center | 2.5/First Outer Layer | 5/Center |
| VMHD | EHWK/NSWK/EHWK | 2/Outer Layers | 2/Center | 2.5/First Outer Layer | 1.5/Center |
| S2HF | EHWK/NSWK/EHWK | 5/Outer Layers | 2/Center | 2.5/First Outer Layer | 8.7/Center |

Figure 4:
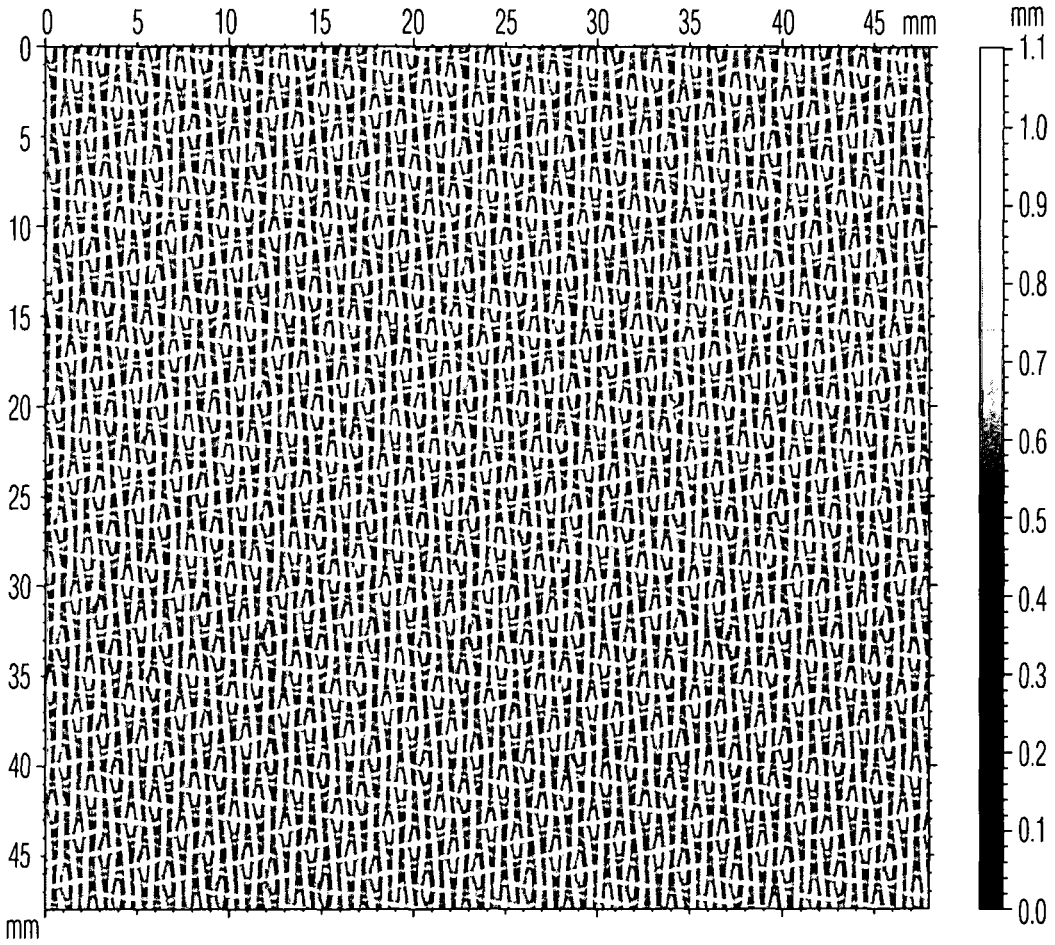
FIG. 4 is a profilometry scan of a through-air drying fabric having a three-dimensional fabric contacting surface useful in the present invention.

The tissue web was formed on a TissueForm V forming fabric (commercially available from Voith Fabrics, Appleton, Wis.), vacuum dewatered to approximately 25 percent consistency and then subjected to rush transfer to a Monoshape M44-AJ-171 transfer fabric (commercially available from AstenJohnson, Charleston, S.C.), which is a 44×36 fabric woven with 0.35 mm diameter machine direction strands and 0.45 mm cross-machine direction strands. The transfer fabric was traveling at a speed about 28 percent slower than the forming fabric. The web was then transferred to either a Natasha (illustrated in FIG. 4) or Alvin TAD fabric (illustrated in FIG. 5) (commercially available from Voith Fabrics, Appleton, Wis.). The web was then non-compressively dried and wound into a parent roll. The basis weight and tensile strength (measured as a two-ply) of the basesheets is summarized in Table 3, below.

TABLE 3

| Sample | Transfer Fabric | TAD Fabric | Basesheet Basis Weight (gsm) | Basesheet GMT (g/3") |
|---|---|---|---|---|
| MCU7 | M44 | NATASHA | 32 | 1240 |
| MCU8 | M44 | NATASHA | 36 | 1290 |
| MCU9 | M44 | NATASHA | 42 | 1205 |
| STLH | M44 | NATASHA | 36 | 1107 |
| MHHL | M44 | NATASHA | 31 | 975 |
| MHLK | M44 | NATASHA | 31 | 978 |
| STMK | M44 | NATASHA | 36 | 1449 |
| VMHD | M44 | NATASHA | 35 | 1104 |
| S2HF | M44 | ALVIN | 28 | 1625 |

The inventive samples were converted into finished product by placing parent rolls of basesheet in two unwinds with the orientation such that the TAD fabric side of the basesheet was facing outward for each of the two plies. The two basesheet plies were then passed through a steel-steel calender section with a loading force of 175 pounds per lineal inch (PLI). Calendered plies were trimmed and passed over a folding board to form the sheet into a C-fold configuration. After folding the plies were wound onto a reel drum to create a sausage of tissue, which was subsequently transferred to a band saw and cut into clips of facial tissue product. The finished clips of tissue product were then subjected to testing, the results of which are summarized in Tables 4 and 5, below.

TABLE 4

| Sample | Basis Weight (gsm) | Caliper (μm) | Sheet Bulk (cc/g) | GMT (g/3") | GM Slope (kg) | CD Tensile (g/3") | CD TEA (g · cm/cm$^2$) | CD Stretch (%) |
|---|---|---|---|---|---|---|---|---|
| MCU7 | 28.3 | 270 | 9.5 | 974 | 9.64 | 671 | 5.7 | 7.5 |
| MCU8 | 33.3 | 271 | 8.1 | 976 | 10.05 | 655 | 5.2 | 7.3 |
| MCU9 | 38.8 | 333 | 8.6 | 795 | 9.24 | 528 | 3.8 | 6.9 |
| STLH | 32.7 | 310 | 9.5 | 812 | 8.99 | 544 | 4.2 | 7.5 |
| MHHL | 29.2 | 243 | 8.3 | 598 | 4.85 | 392 | 2.9 | 6.0 |
| MHLK | 29.3 | 206 | 7.0 | 634 | 10.62 | 402 | 2.1 | 4.6 |
| STMK | 33.7 | 305 | 9.1 | 1075 | 10.62 | 722 | 5.1 | 7.2 |
| VMHD | 32.2 | 276 | 8.6 | 707 | 8.51 | 457 | 3.0 | 6.3 |
| S2HF | 25.4 | 236 | 9.3 | 1264 | 17.00 | 940 | 11.6 | 10.2 |

TABLE 5

| Sample | Stiffness Index | R1 | R2 | T57 | T5750 |
|---|---|---|---|---|---|
| MCU7 | 9.90 | 10,295 | 11,210 | 10.96 | 21.40 |
| MCU8 | 10.30 | 10,297 | 11,115 | 10.25 | 26.78 |
| MCU9 | 11.62 | 11,038 | 12,400 | 8.76 | 29.82 |
| STLH | 11.08 | 11,189 | 12,202 | 9.24 | 25.97 |
| MHHL | 8.10 | 12,973 | 16,329 | 10.06 | 24.20 |
| MHLK | 16.74 | 11,631 | 14,123 | 9.85 | 33.40 |
| STMK | 9.88 | 11,654 | 12,529 | 10.87 | 33.20 |
| VMHD | 12.04 | 13,033 | 15,149 | 10.35 | 44.78 |
| S2HF | 13.45 | 11,213 | 11,502 | 9.24 | 26.35 |

To gain an understanding of the topography of each product a Keyence VHX-5000 Digital Microscope was used to measure the height of the three-dimension surface topography of the product. Products were placed under a glass microscope slide, which was weighted and a 3D stitched image was taken of the area under the glass slide. Once the 3D image was taken, a line was drawn across the middle MD position of the image and the average function was used to create 10 lines spaced at 5 μm increments from which a CD profile of the product was generated. The height of the protuberances was measured based upon the CD profile and varied from about 150 μm to about 200 μm.

While tissue webs, and tissue products comprising the same, have been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the foregoing embodiments:

In a first embodiment the present invention provides a tissue product comprising at least one through-air dried ply, the tissue product having a TS7 less than 11.0 and an R2 value from about 11,000 to about 20,000.

In a second embodiment the present invention provides the tissue product of the first embodiment having a sheet bulk greater than about 8.0 cc/g.

In a third embodiment the present invention provides the tissue product of the first or second embodiments having a TS7 less than about 10.0 and an R2 value from about 12,000 to about 20,000.

In a fourth embodiment the present invention provides the tissue product of any one of the first through third embodiments having geometric mean tensile (GMT) strength greater than about 700 g/3".

In a fifth embodiment the present invention provides the tissue product of any one of the first through fourth embodiments having a Stiffness Index less than about 15.0.

In a sixth embodiment the present invention provides the tissue product of any one of the first through fifth embodiments having and an R1 value from about 11,000 to about 15,000 and an R2 value from about 11,000 to about 20,000.

In a seventh embodiment the present invention provides the tissue product of any one of the first through sixth embodiments having a TS750 from about 30 to about 50.

In an eighth embodiment the present invention provides the tissue product of any one of the first through seventh embodiments having an R1 value from about 11,000 to about 15,000.

In a ninth embodiment the present invention provides the tissue product of any one of the first through eighth embodiments having a TS7 value from 7.0 to 11.0.

In a tenth embodiment the present invention provides the tissue product of any one of the first through ninth embodiments wherein the at least one through-air dried ply comprises a plurality of pulp fibers and is uncreped.

In an eleventh embodiment the present invention provides the tissue product of any one of the first through tenth embodiments wherein the tissue product comprises at least one creped through-air dried ply.

In a twelfth embodiment the present invention provides the tissue product of any one of the first through eleventh embodiments wherein the tissue product comprises two plies and each ply is an uncreped through-air dried tissue web.

In a thirteenth embodiment the present invention provides the tissue product of any one of the first through twelfth embodiments wherein the tissue product comprises two through-air dried tissue plies, each ply having a machine direction axis and a cross-machine direction axis and a first and a second surface, the first surface comprising a three-dimensional surface topography comprising a plurality of discrete protuberances having an angle of orientation, relative to the machine direction axis of the ply, has a three-dimensional surface topography imparted by a through-air drying fabric, the three-dimensional surface topography comprising a plurality of discrete protuberances having an angle of orientation, relative to the machine direction axis of the product, from about 10 to about 30 degrees.

In a fourteenth embodiment the present invention provides the tissue product of any one of the first through thirteenth embodiments wherein the tissue product has a TS7 value from 7.0 to 10.0, a TS750 greater than 30, and an R2 value from about 12,000 to about 20,000.

What is claimed is:

1. A wet-laid tissue product comprising two or more wet-laid, through-air dried tissue plies consisting essentially of wood pulp fibers, the product having a TS7, from about 7.0 to 11.0, an R2 value from about 11,000 to about 20,000, a geometric mean tensile (GMT) strength from about 700 to about 1,200 q/3", a basis weight from about 15 to about 50 grams per square meter (qsm), and a sheet bulk greater than about 8.0 cc/q.

2. The tissue product of claim 1 having a geometric mean slope (GM Slope) less than about 15.0 kg.

3. The tissue product of claim 1 having an R1 value from about 11,000 to about 15,000.

4. The tissue product of claim 1 having an R1 value from about 11,000 to about 15,000 and an R2 value from about 11,000 to about 20,000.

5. The tissue product of claim 1 having a TS750 from about 30 to about 50.

6. A multi-ply tissue product comprising two or more through-air dried tissue plies, each ply consisting essentially of wood pulp fibers and having a machine direction axis, a cross-machine direction axis, a first surface and a second surface, the first surface comprising a three-dimensional surface topography comprising a plurality of discrete protuberances having an angle of orientation, relative to the machine direction axis of the ply, from about 10 to about 45 degrees, the product having a TS7 value less than 11.0 and an R2 value from about 11,000 to about 20,000.

7. The tissue product of claim 6 wherein the two or more through-air dried tissue plies are uncreped.

8. The tissue product of claim 6 wherein the two or more through-air dried tissue plies are creped.

9. The tissue product of claim 6 wherein the TS7 is from about 7.0 to 11.0 and the R2 value is from about 12,000 to about 20,000.

10. The tissue product of claim 6 having a basis weight from about 15 to about 50 grams per square meter (gsm) and a sheet bulk greater than about 8.0 cc/g.

11. The tissue product of claim 10 having a geometric mean tensile (GMT) strength from about 700 to about 1,200 g/3" and geometric mean slope (GM Slope) less than about 15.0 kg.

12. The tissue product of claim 6 having an R1 from about 11,000 to about 15,000 and an R2 value from about 11,000 to about 18,000.

13. The tissue product of claim 6 having a TS750 value from about 30 to about 50.

14. The tissue product of claim 6 wherein the discrete protuberances have an angle of orientation, relative to the machine direction axis of the ply, from about 10 to about 30 degrees, and a height from about 150 to about 200 μm.

* * * * *